US009951913B2

(12) United States Patent
Skergeth et al.

(10) Patent No.: US 9,951,913 B2
(45) Date of Patent: Apr. 24, 2018

(54) LIGHT FIXTURE COMPRISING A CARRIER ELEMENT AND DETACHABLY SECURABLE LIGHTING MODULE

(71) Applicant: ZUMTOBEL LIGHTING GMBH, Dornbirn (AT)

(72) Inventors: Sascha Skergeth, Lustenau (AT); Michael Kohler, Dornbirn (AT); Thomas Kottek, Lustenau (AT); Cristian Olariu, Dornbirn (AT); Norbert Peter, Hohenems (AT); Sebastian Schubnell, Kressbronn (DE); Daniel Steurer, Sibratsgfäll (AT)

(73) Assignee: ZUMTOBEL LIGHTING GMBH (AT)

( * ) Notice: Subject to any disclaimer, the term of this patent is extended or adjusted under 35 U.S.C. 154(b) by 0 days.

(21) Appl. No.: 15/122,511

(22) PCT Filed: Mar. 3, 2015

(86) PCT No.: PCT/EP2015/054353
§ 371 (c)(1),
(2) Date: Aug. 30, 2016

(87) PCT Pub. No.: WO2015/132225
PCT Pub. Date: Sep. 11, 2015

(65) Prior Publication Data

US 2017/0074470 A1 Mar. 16, 2017

(30) Foreign Application Priority Data

Mar. 3, 2014 (DE) ..... 20 2014 100 951 U

(51) Int. Cl.
*F21S 4/00* (2016.01)
*F21S 2/00* (2016.01)
(Continued)

(52) U.S. Cl.
CPC ..... *F21S 2/005* (2013.01); *F21S 4/28* (2016.01); *F21S 8/04* (2013.01); *F21V 15/01* (2013.01);
(Continued)

(58) Field of Classification Search
CPC ..... F21S 2/005; F21S 4/28; F21S 8/04; F21V 15/01; F21V 19/004; F21V 23/06
See application file for complete search history.

(56) References Cited

U.S. PATENT DOCUMENTS

2005/0002182 A1 1/2005 Kotovsky et al.
2006/0262544 A1 11/2006 Piepgras et al.
(Continued)

FOREIGN PATENT DOCUMENTS

DE 19615600 10/1997
DE 202010000463 7/2010
(Continued)

OTHER PUBLICATIONS

International Search Report in parent PCT application PCT/EP2015/054353 dated May 21, 2015.
(Continued)

*Primary Examiner* — Alexander Garlen
(74) *Attorney, Agent, or Firm* — Andrus Intellectual Property Law, LLP

(57) ABSTRACT

The invention relates to a light fixture (1) comprising an elongated carrier element (5), at least one lighting module (20), which can be detachable secured to the carrier element (5), and means for supplying power to the lighting module (20), said means comprising contacts arranged on the carrier element (5) or on one of the device carriers (50) held by the carrier element (5). In said light fixture, spring contacts (41) constitute at least some of the contacts.

11 Claims, 4 Drawing Sheets

(51) Int. Cl.

| | |
|---|---|
| ***F21S 8/04*** | (2006.01) |
| ***F21V 15/01*** | (2006.01) |
| ***F21V 23/06*** | (2006.01) |
| ***F21S 4/28*** | (2016.01) |
| ***F21V 19/00*** | (2006.01) |
| *F21Y 103/10* | (2016.01) |
| *F21Y 115/10* | (2016.01) |

(52) U.S. Cl.
CPC ..... *F21V 19/004* (2013.01); *F21V 23/06* (2013.01); *F21Y 2103/10* (2016.08); *F21Y 2115/10* (2016.08)

(56) References Cited

U.S. PATENT DOCUMENTS

2010/0188840 A1 7/2010 Cho et al.
2010/0277908 A1 11/2010 Hu et al.
2011/0075413 A1 3/2011 Smith et al.
2011/0242811 A1 10/2011 Cheng
2012/0113657 A1* 5/2012 Wakimoto ..... F21V 19/045 362/398
2013/0058091 A1 3/2013 Hast et al.
2013/0176728 A1* 7/2013 Bizzotto ..... F21V 21/08 362/244
2013/0201697 A1 8/2013 Osada et al.
2013/0229802 A1 9/2013 Fukushima et al.
2013/0329438 A1* 12/2013 Wakahara ..... F21V 19/003 362/396
2014/0104857 A1 4/2014 Spintge et al.
2014/0140041 A1* 5/2014 Spintge ..... F21K 9/00 362/95
2014/0233227 A1* 8/2014 Diekmann ..... F21V 17/12 362/225

FOREIGN PATENT DOCUMENTS

| | | |
|---|---|---|
| DE | 202010005681 | 10/2010 |
| DE | 102010038251 | 4/2012 |
| DE | 202012100270 | 6/2013 |
| EP | 2375128 | 10/2011 |
| EP | 2557359 | 2/2013 |
| EP | 2650607 | 10/2013 |
| JP | 5257556 | 8/2013 |
| WO | 2011151272 | 12/2011 |

OTHER PUBLICATIONS

German search report on priority application DE 20 2014 100 951.5 dated Aug. 2, 2014.
Austria search report co-pending Austria application GM 337/2014 dated Aug. 21, 2015.

* cited by examiner

LIGHT FIXTURE COMPRISING A CARRIER ELEMENT AND DETACHABLY SECURABLE LIGHTING MODULE

CROSS REFERENCE TO RELATED APPLICATION

The present application is the U.S. national stage application of International Application PCT/EP2015/054353, filed Mar. 3, 2015, which international application was published on Sep. 11, 2015 as International Publication WO 2015/132225 A1. The International Application claims priority of German Patent Application 20 2014 100 951.5, filed Mar. 3, 2014.

FIELD OF THE INVENTION

The present invention relates to a light fixture, which has an elongated carrier element and at least one lighting fixture that can be detachably secured to the carrier element.

BACKGROUND

The idea of arranging lighting modules on a carrier element such that they are interchangeable is known in particular from so-called strip light systems. These are lighting systems having an elongated carrier element, e.g. a U-shaped mounting rail open toward the bottom, running in or on the electrical lines for supplying electrical current, as well as for signal transmission, if applicable. Depending on the design of the system, lighting modules can then be arranged at specific, predefined positions, or freely at arbitrary locations of the mounting rail. Each lighting module has special contact elements—e.g. in the form of so-called rotary toggles—which produce a mechanical attachment to the mounting rail on one hand, and also ensure contact to the electrical lines on the other hand. Furthermore, the lighting modules normally each have their own operating device, which converts the network supply voltage, provided via the electrical lines running along the mounting rail, into a suitable operating voltage for operating the light sources of the lighting modules.

A detachable arrangement of individual modules, each of which contain light sources, would also make sense with individual light fixtures, in particular when the light sources that are to be used are LEDs. In comparison with conventional light sources such as incandescent bulbs or fluorescent lamps, the replacement of defective LEDs or defective LED boards is normally difficult to carry out for the end user, such that in the event of such a defect, either the light fixture must be replaced or sent to the manufacturer, or repairs must be made by a trained electrician. This is because, for safety reasons, LED boards must normally be incorporated in light fixtures such that they are difficult to access. One reason for this is that, the danger of electric shocks is eliminated or at least reduced. Furthermore, an unintentional touching of an LED board may lead to so-called ESD damage, i.e. damage attributable to an undesired electrical discharge. As a result, LED light sources in light fixtures are normally arranged in specially protected or encapsulated ways, and access to the boards can frequently only be obtained by destroying certain components, which comprise such a protection.

There are ways to avoid the problems described above, in which the LEDs are provided in special encapsulated modules that are detachably secured to the light fixture, and are electrically coupled thereto using appropriate means for providing current. In the case of a defective LED, instead of replacing the specific board on an individual basis, the entire module is replaced, which normally can also be relatively easily carried out by the end user.

In order, however to actually enable a simple replacement of individual modules by the end user with light fixtures of the type described above, it must be ensured that with a replacement of a lighting module, or with the initial arrangement of the lighting module on the carrier element, respectively, the electrical connection to the operating device for the light fixture is reliably and securely produced. The present invention addresses the object of providing a solution for this.

SUMMARY OF THE INVENTION

This objective is achieved by means of a light fixture having the features described herein.

In comparison with solutions known so far, in which primarily plug systems are used, it is proposed according to the present invention, that the current supply for the lighting module that is to be connected thereto is produced by means of contacts, which are formed by spring contacts according to the invention.

According to the present invention, a light fixture having an elongated carrier element and at least one lighting module is proposed, which can be detachably secured to the carrier element. The light fixture furthermore has means thereby for supplying current to the lighting module, which comprise contacts disposed on the carrier element or on one of the device carriers secured in the carrier element, wherein the contacts are formed by spring contacts.

It has been shown that by using the spring contacts, the electrical connection between the operating device and the lighting module can be produced easily but very reliably. The replacement of a defective module by the end user is significantly simplified as a result.

According to a particularly preferred exemplary embodiment, the lighting module has counter-contacts on a base surface facing the carrier element, which can be formed, in particular, by an LED board, for interacting with the spring contacts. These counter-contacts on the lighting module can be formed, in particular, by contacting panels applied to the base surface of the lighting module. As a result, the contact is enabled in a very simple and secure manner, on one hand, and on the other hand, the lighting module has a flat back surface in this exemplary embodiment. This is not only advantageous for transporting the lighting module, because damage to protruding elements, such as plugs or bushings, can be avoided as a result, a planar base surface furthermore ensures that it can be placed flatly on the carrier element for the light fixture. This is relevant insofar as, during operation of the light sources, a not inconsiderably amount of heat results, which can be very efficiently transferred, due to the flat contact between the lighting module and the carrier element, and then discharged into the environment.

There are preferably two groups of contacts on the lighting module, in particular two groups of the aforementioned contacting panels are provided, which are disposed such that the lighting module can establish contact in two positions, rotated 180°, of the spring contacts on the carrier element. The reason for this measure is that in this case, lighting modules can also be used that produce an asymmetrical light emission, wherein this module can be disposed in different orientations on the carrier element. In the case of an elongated light fixture, it would be certainly conceivable that, in the end regions of the carrier element, lighting modules are used that emit a stronger light in a specific direction, wherein it is then necessary in order to obtain an overall symmetrical light emission to use identical, asymmetrical, light modules on opposite ends of the carrier element, which however, are positioned such that they are rotated 180° in relation to one another. By using the two groups of contacts specified above, it is ensured that the lighting module can be efficiently coupled to the spring contacts in both positions, such that in any case, electrical current supply is ensured.

The spring contacts used according to the invention are preferably not disposed directly on the carrier element itself, but rather on a device carrier secured on the carrier element. This is disposed, in particular, on the side of the carrier element facing away from the lighting module, wherein the spring contacts pass through holes formed in the carrier element. As a result of this measure, it is ensured that further current conducting elements cannot be touched from the side accessible to the end user, and a replacement of a single module can, accordingly, be easily and securely carried out.

Ultimately, it is thus ensured by the solution according to the invention, that work that previously had to be carried out primarily by trained electricians can now be also carried out by the end user in a simple and secure manner.

BRIEF DESCRIPTION OF THE DRAWINGS

The invention shall be explained below in greater detail, based on the attached drawings. Therein.

DETAILED DESCRIPTION

Figure 2:
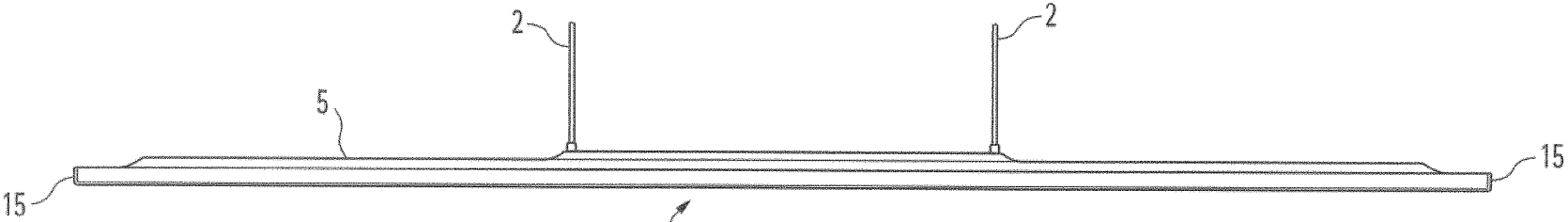
FIG. 2 shows a side view of the light fixture according to the invention.
Figure 1:
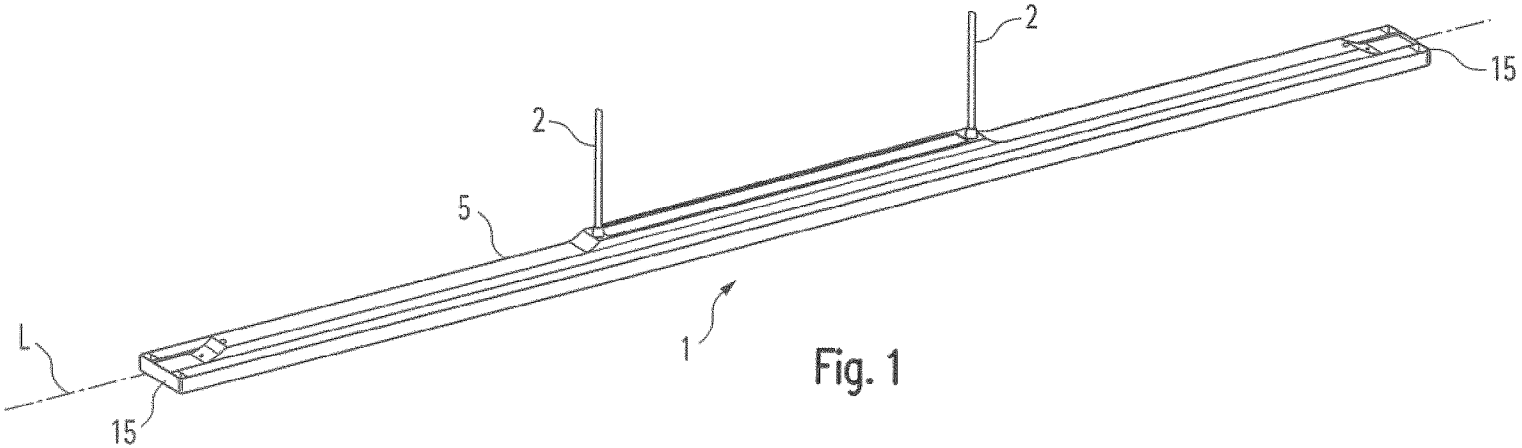
FIG. 1 shows a light fixture according to the invention, in a perspective view, diagonally from above.
Figure 3:
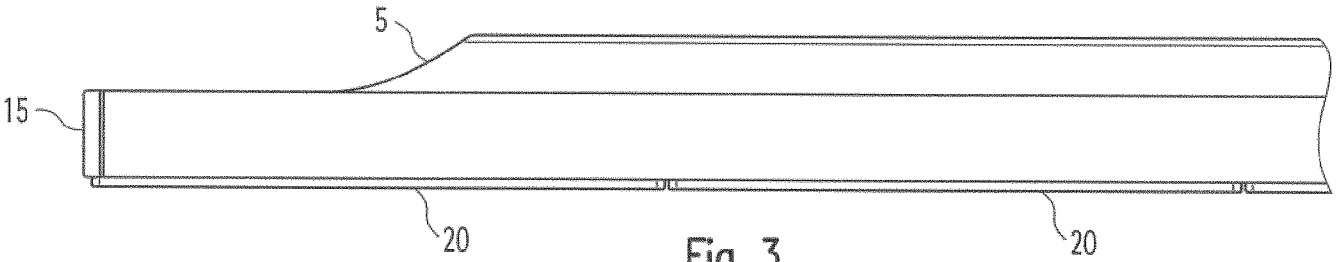
FIG. 3 shows an enlarged side view of the end region of the light fixture.

FIGS. 1 and 2 show different views of the light fixture according to the invention, provided on the whole with the reference symbol 1. The light fixture 1 is designed as a suspended light fixture in the depicted exemplary embodiment, and can be secured, in this case, via at least one suspension element, on the ceiling of a room, for example; in the depicted case via numerous cords 2 on a carrier element (not shown). In a slightly modified manner, the light fixture 1 according to the invention could, however, also be used as a ceiling light fixture.

As can be seen in the figures, the light fixture 1 on the whole has an elongated design, and extends thereby along a longitudinal axis L. The shape of the light fixture 1 is established primarily by a carrier element 5, which represents the central element of the light fixture 1, and on which all of the other components are disposed, or secured, respectively. A substantial feature of this carrier element 5 is that it forms a receiving region having a U-shaped cross section on its undersurface, or its light emitting surface, which shall be described in greater detail below, in which numerous lighting modules can be disposed such that they can be exchanged. The carrier element 5 is preferably formed by an aluminum profile, which is closed by end caps 15 on both ends, which in turn are releasably secured to the carrier element 5.

Figure 5:
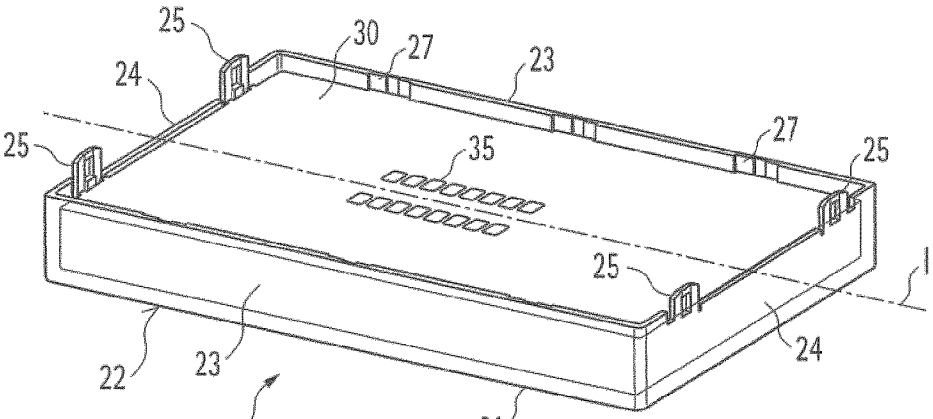
FIG. 5 shows a lighting module that is to be detachably secured to the light fixture.
Figure 8:
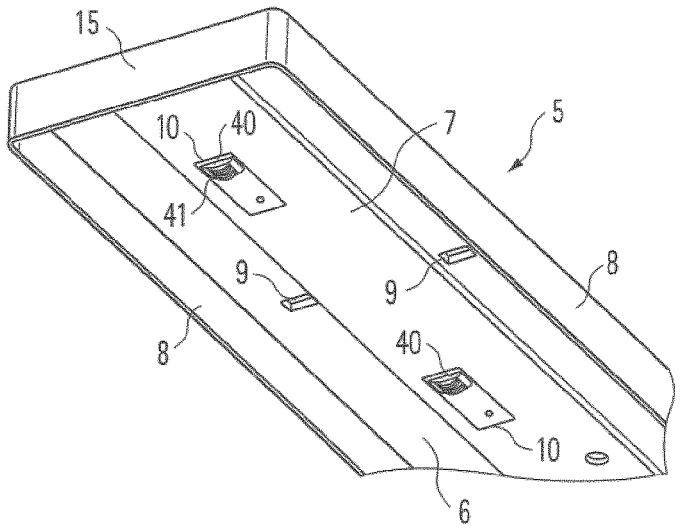
FIG. 8 shows a perspective view of an end region of the carrier element for the light fixture, having the spring contacts located thereon.

FIG. 8 shows the end region of the carrier element 5 from below, wherein the receiving region 6 for the exchangeable lighting modules can be seen. This receiving region is formed by a base surface 7, as well as two U-legs 8 running on both sides of the base surface 7, directed downward. Together with the aforementioned end elements, or closure caps 15, the trough-shaped receiving region 6 is formed, seen as a whole having a U-shaped cross section. Numerous lighting modules—14 lighting modules in the depicted exemplary embodiment—are then disposed therein, wherein one of these is shown in FIG. 5 in a perspective view.

The lighting module 20 basically thus has a rectangular shape in the present exemplary embodiment. As can be derived in particular from the sectional views of FIGS. 6 and 7, the lighting module 20 is composed thereby of a trough-like designed so-called lens mount 21, made of a translucent or transparent material, which has a base surface 22, forming the light emitting surface of the lighting module 20, as well as four side walls 23, 24. Two snap-in lugs 25 are formed in each case on the two shorter side walls 24, are used to secure the carrier element 5 of the light fixture 1. As can be derived from the depiction in FIG. 8, corresponding snap-in recesses, or slits 9, are formed for this in the base surface 7 of the receiving region 6 of the carrier element 5, in which the snap-in lugs 25 of the lighting module 20 engage.

Figure 6:
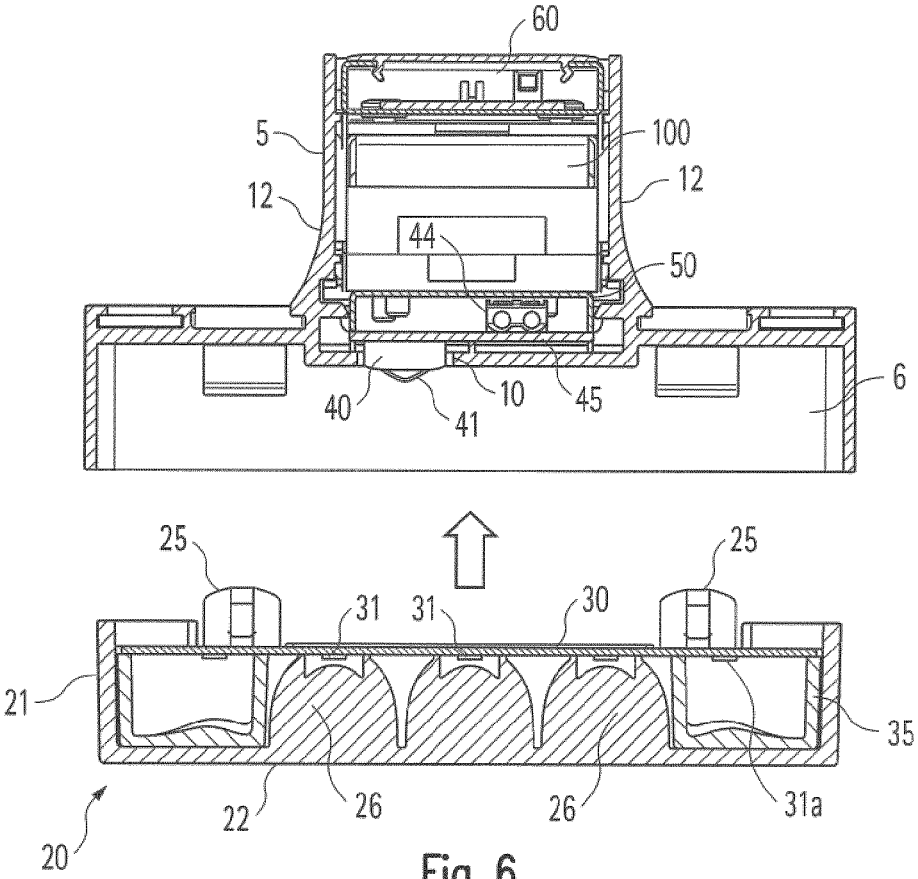
FIG. 6 shows a sectional view of the light fixture, transverse to the longitudinal axis, wherein the exchangeable lighting module is disposed at a spacing to the carrier element.

The base surface of the lighting module 20 is formed by the back surface of a board 30 having numerous LEDs 31 disposed thereon, preferably distributed in the manner of a matrix (see FIG. 6). These LEDs 31 represent the light sources for the lighting module 20, wherein the LEDs 31 are assigned different optical means that have an effect on the light emission.

Figure 4:
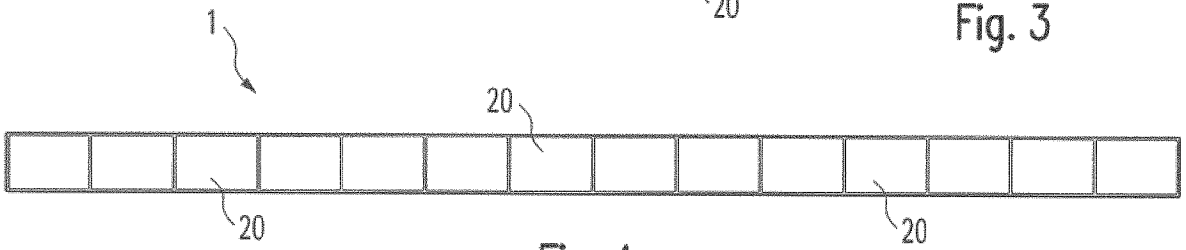
FIG. 4 shows a view of the light fixture according to the invention from below.

As can be seen in FIG. 6, lenses 26 are formed in the central region of the lens mount 21, to which individual LEDs 31 are assigned in each case. The light from the LEDs 31*a* located in the edge regions, in contrast, is not emitted such that it is directed by lenses, but rather, should elicit a more diffused encompassing illumination frame. This is obtained by means of a special diffuser frame, which is placed in the lens mount 21, and, in comparison with the lens mount 21, which is preferably made of a clear material, is made of a light diffusing material, or contains light diffusing particles, respectively. It should be noted, however, that as a matter of course, the design for the optical elements for individual lighting modules can also be designed differently, if another light emission is desired. The design for these optical elements is of no greater relevance for the fundamental concept of the present invention. The important thing is that numerous lighting modules 20 are secured on the carrier element 5 of the light fixture 1, such that an appearance of the undersurface, or the light emitting surface, respectively, of the light fixture 1, such as that depicted in FIG. 4, is obtained in this regard.

The LED board 30 forming the back surface of the lighting module 20 is locked in place on the lens mount 21. Corresponding latching elements 27 for this are formed on the two side walls 23, which interact with the board 30 such that, in a simple manner, they can be placed from behind on the open lens mount 21 and then removed therefrom by pressing against them. In this manner, a stable component is formed, by means of which, in turn, the individual LEDs 31 are efficiently protected against external effects.

The power supply for the lighting modules 20 disposed on the carrier element 5 is obtained using special contacting means, which comprise spring contacts 41 according to the present invention, which interact with the contact panels 35 disposed on the back surface of the LED board 30. The spring contacts 41, which are connected to the operating device for the light fixture 1 in a manner that shall be described in greater detail below, are disposed here, in each case, on a contact block 40, which can be seen, for example, in FIG. 6, which extends through a corresponding hole 10 in the base surface 7 of the receiving region 6 of the carrier element 5. This means that these spring contacts 41 can be accessed from the receiving region 6 of the carrier element 5 such that they come in contact with the contact panels 35 of the lighting module 20 when the lighting module 20 is inserted. As a result, the electrical connection between the spring contacts 41 and the lighting module 20, and thus, ultimately the current supply for the lighting module 20, is ensured.

As can be derived from the depiction in FIG. 5, a number of contact panels 35 are formed on the back surface of the LED board 30, wherein, depending on the operating mode of the light fixture 1, not all of the contact panels 35 must be used. This depends on, among other things, whether only a simple on- and off-switching of the module 20 is intended, or these are to enable individual control thereof. In the depicted exemplary embodiment, only two spring contacts 41 are used, such that the module 20 can thus be supplied exclusively with a suitable supply voltage, or supply current, and all of the modules can, accordingly, be operated as a unit. A communication, which furthermore also would enable the transmission of error data or suchlike, is not provided for in the depicted exemplary embodiment, wherein, in this case, more of the contact panels 35 would be used, as needed.

Another special feature consists of the fact that—as can be seen in FIG. 5—two rows of contact panels 35 are provided, which are rotated 180° in relation to one another with respect to the longitudinal axis 1 of the lighting module 20. The reason for this measure is that, as a result, there is the possibility of arranging the lighting module 20 selectively in different orientations on the carrier element 5, in particular in two orientations rotated about 180°. This may be useful when the optical elements of the lighting module 20 are designed such that they elicit an asymmetrical light emission, which is stronger in one direction. In this case, it may be provided that the lighting modules 20 disposed on the respective end regions of the carrier element 5 are oriented such that they are rotated in relation to one another, which in turn would elicit a symmetrical light emission by the light fixture 1 when seen as a whole. By providing two identical contact panel groups, which however are rotated 180° in relation to one another, a corresponding selective arrangement of the lighting modules 20 can be enabled in a simple manner, without having to otherwise modify it.

Figure 7:
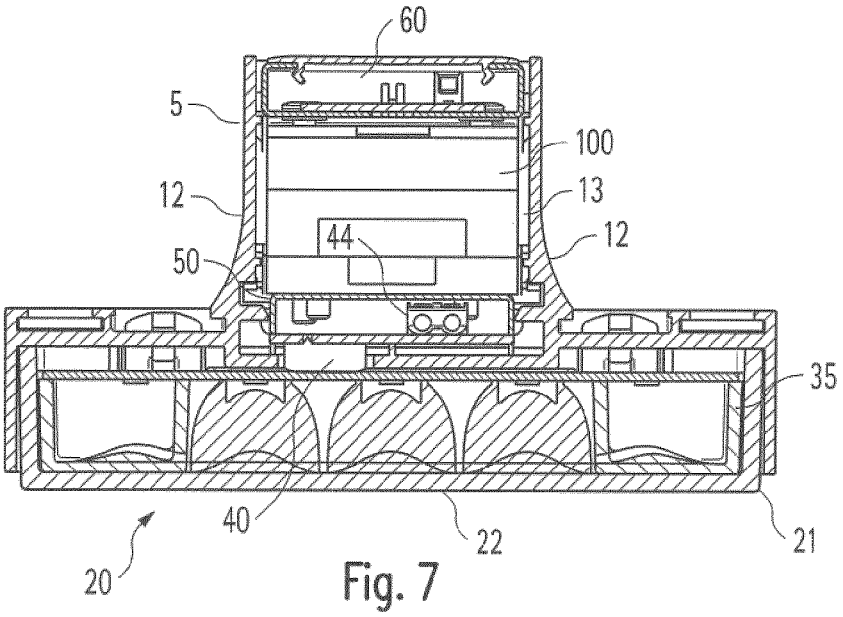
FIG. 7 shows a sectional view corresponding to FIG. 6, wherein the light fixture is now secured to the carrier element.

FIGS. 6 and 7 show a sectional view of the light fixture 1, as has already been mentioned, wherein, first, in FIG. 6 the lighting module 20 is disposed at a spacing to the carrier element 5, and in FIG. 7 it is secured to the carrier element 5. The shape of the carrier element 5 can furthermore be derived from the depictions in FIGS. 6 and 7, wherein it can be seen that this has two side walls 12 running in the longitudinal direction, above the U-shaped receiving region 6 for the lighting modules 20, which form a narrower, second receiving region 13, facing upward, and again having a U-shaped cross section, in which the lamp operating device 100, as well as additional units 60, if applicable, for implementing an indirect lighting, are disposed, which shall not be explained in greater detail below, however.

Figure 9:
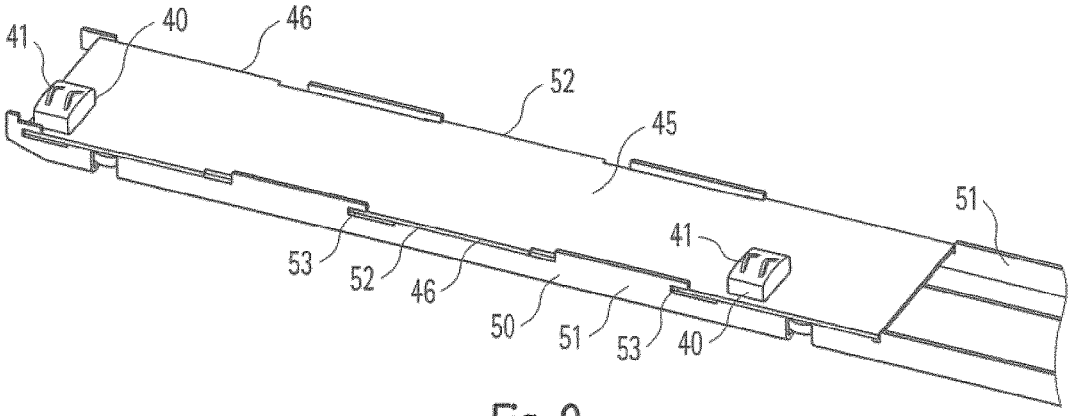
FIG. 9 shows the view of the end region of a device carrier, which is disposed on the carrier element according to a preferred embodiment, and on which the spring contacts are disposed.

Advantageously, the contact blocks 40 having the spring contacts 41 are not directly disposed on the carrier element 5, but rather, are disposed on a so called device carrier 50, which is depicted in FIG. 9. This is formed by an elongated sheet metal part, and serves as the central retaining element for the components for the power supply to the lighting module 20. The contact blocks 40 having the spring contacts 41 are, in turn, not disposed directly on the device carrier 50, but rather, are mounted on so-called connecting boards 45. These connecting boards 45, wherein one of which is depicted in FIG. 9, each have, thereby, two contact blocks 40, having spring contacts 41, and are thus designed for establishing a contact to two lighting modules 20.

The arrangement of the connecting boards 45 on the device carrier 50 occurs in turn, preferably without tools, which is achieved in that the boards 45 have elongated protrusions 46 on their longitudinal sides. These are provided to be connected to the device carrier 50 in the manner of a bayonet locking. The device carrier 50, having an bowed, C-shaped cross section, has two elongated side walls 51 for this, in which holes 52 are formed in each case, which open into undercuts 53. The connecting boards 45 are then inserted from above (in accordance with the depiction in FIG. 9), such that the protrusions 46 engage in the holes 52. Subsequently, the boards 45 are displaced in relation to the device carrier 50, in the direction of the arrow, such that the protrusions engage in the undercuts 53. As a result, the boards 45 are securely supported on the device carrier 50, without there being a need for a tool or additional joining means. Numerous corresponding connecting boards 45 are then disposed in this manner on the device carrier 50, wherein in the present case, half as many boards 45 are needed as the lighting modules 20 that are to be secured to the carrier element 5 for the light fixture 1.

Furthermore, a plug 44 or a clamp is disposed on each of the connecting boards 45, which is connected to the contact blocks 40 via conductor paths, not depicted in detail. The plug 44 is located on the side of the board 45 opposite the contact blocks 40, and is connected to the operating device 100—which is likewise disposed on the device carrier 50—via cables. In this manner, the electrical connection between the operating device 100 and the contact blocks 40 is thus ensured.

The pre-assembled component comprising the device carrier 50 with the operating device 100 located thereon, as well as the connecting boards 45, is then inserted from above into the carrier element 5, and locked in place therein, such that ultimately, the configuration depicted in FIGS. 6 and 7 is obtained. As has already been stated, the individual components are disposed thereby, such that the contact blocks 40 extend with the spring elements 41 through the holes 10 in the carrier element 5, and all of the other current conducting elements, in contrast, are inaccessible from below, on which the lighting modules 20 are mounted, or from which they are removed.

The solution according to the invention thus enables a simple production of the electrical connection and thus the current supply to the exchangeable lighting modules. The depicted, preferred embodiment is furthermore distinguished in that the lighting modules have a planar back surface, and therefore can bear on the carrier element with the entire surface area thereof, which likewise represents a significant advantage with respect to an efficient discharge of the heat resulting during the operation of the light fixture.

What is claimed is:

1. A light fixture (1), having an elongated carrier element having a receiving region with a U-shaped cross section on its underside for receiving one or more lighting modules, at least one lighting module, which can be detachably secured to the carrier element, the lighting module comprising an LED board and a lens mount which holds the LED board and detachably secures the lighting module within the receiving region of the elongated carrier element, wherein a surface of the LED board forms a base surface of the lighting module facing the elongated carrier element when the lighting module is secured within the receiving region of the elongated carrier element, and means for providing the lighting module with power, comprising contacts, which are disposed on the carrier element, or a device carrier supported by the carrier element, wherein at least a portion of the contacts is formed by spring contacts.

2. The light fixture according to claim 1, characterized in that the lighting module has counter-contacts on a base surface facing the carrier element, for interacting with the spring contacts.

3. The light fixture according to claim 2, characterized in that the counter-contacts are formed by contacting panels applied to the base surface.

4. The light fixture according to claim 2, characterized in that the lighting module has two functionally identical groups of counter-contacts, with each group disposed in a row symmetrically on opposing sides of a central longitudinal axis of the lighting module with functionally identically positions in different rows rotated 180° in relation to one another such that the lighting module can contact the spring contacts with counter-contacts in either one of the groups of counter-contacts depending on the orientation of the lighting module within the receiving region of the elongated carrier element.

5. The light fixture according to claim 1, characterized in that the spring contacts are disposed on a device carrier, which is disposed on the side of the carrier element facing away from the lighting module, wherein the spring contacts or contact blocks supporting the spring contacts pass through holes formed in the carrier element.

6. The light fixture according to claim 5, characterized in that a lamp operating device is disposed on the device carrier, which is connected to the spring contacts (41), said operating device converting network supply voltage into a suitable operating voltage for LED light sources on the respective LED boards.

7. The light fixture according to claim 5, characterized in that the device carrier can be detachably connected to the carrier element, in particular, it can be snapped in place thereon.

8. The light fixture according to claim 1 wherein the light fixture comprises a device carrier supported by the carrier element, and connecting boards mounted to the device carrier, wherein said spring contacts extend downward from the connecting boards.

9. The light fixture according to claim 8 wherein a plug or clamp is disposed on the each respective connecting board on the side opposite the spring contacts, and said plug or clamp is connected to a contact block for the spring contacts via a conductor path on the connecting board.

10. The light fixture according to claim 1 wherein the lens mount is configured to be snapped in to place on the elongated carrier element within the receiving region.

11. The light fixture according to claim 1 comprising multiple lighting modules, with the lens mount of each lighting module having a rectangular shape.

* * * * *